US009053668B2

(12) United States Patent
Yoon et al.

(10) Patent No.: US 9,053,668 B2
(45) **Date of Patent: *Jun. 9, 2015**

(54) ORGANIC LIGHT EMITTING DIODE DISPLAY DEVICE

(71) Applicant: LG Display Co., Ltd., Seoul (KR)

(72) Inventors: Joongsun Yoon, Paju-si (KR); Younghak Lee, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 134 days.

This patent is subject to a terminal disclaimer.

(21) Appl. No.: 13/675,737

(22) Filed: Nov. 13, 2012

(65) Prior Publication Data

US 2013/0127692 A1 May 23, 2013

(30) Foreign Application Priority Data

Nov. 18, 2011 (KR) ..... 10-2011-0121137

(51) Int. Cl.
*G09G 3/32* (2006.01)

(52) U.S. Cl.
CPC ..... *G09G 3/3258* (2013.01); *G09G 3/3233* (2013.01); *G09G 2300/0852* (2013.01); *G09G 2300/0861* (2013.01); *G09G 2320/0295* (2013.01); *G09G 2300/0819* (2013.01)

(58) Field of Classification Search
USPC ..... 345/204
See application file for complete search history.

(56) References Cited

U.S. PATENT DOCUMENTS

| | | | | |
|---|---|---|---|---|
| 8,188,991 | B2 * | 5/2012 | Ohhashi et al. | 345/204 |
| 2009/0237378 | A1 * | 9/2009 | Ohhashi et al. | 345/204 |
| 2010/0045646 | A1 * | 2/2010 | Kishi | 345/211 |
| 2011/0141084 | A1 * | 6/2011 | Kishi | 345/211 |

FOREIGN PATENT DOCUMENTS

CN 102047312 A 5/2011

OTHER PUBLICATIONS

State Intellectual Property Office of the People's Republic of China, First Office Action, Chinese Patent Application No. 201210465647.2, Sep. 25, 2014, sixteen pages.

* cited by examiner

*Primary Examiner* — Van Chow
(74) *Attorney, Agent, or Firm* — Fenwick & West LLP

(57) ABSTRACT

An organic light emitting diode display device comprises: a display panel having a plurality of pixels, each of the pixels comprising: a driving TFT comprising a gate electrode coupled to a first node, a source electrode coupled to a second node, and a drain electrode coupled to a high-potential voltage source; an organic light emitting diode comprising an anode coupled to the second node and a cathode coupled to a low-potential voltage source; a first TFT in response to a scan signal having a first logic level voltage to connect the first node to a data line; a second TFT in response to an emission signal having the first logic level voltage to connect the second node to the third node; a first capacitor coupled between the first node and the third node; and a second capacitor coupled between the third node and a reference voltage source.

20 Claims, 13 Drawing Sheets

FIG. 4

| 기간 | N1 | N2 | N3 |
|---|---|---|---|
| t1 | Vpre | - | - |
| t2 | Vpre | VDD_L | VDD_L |
| t3 | Vpre | Vpre-Vth | Vpre-Vth |
| t4 | DATA | ≒Vpre-Vth | Vpre-Vth -C'(Vpre-DATA) |
| t5 | DATA+(Voled_anode-[Vpre-Vth-C'(Vpre-DATA)]) | Voled_anode | Voled_anode |

ORGANIC LIGHT EMITTING DIODE DISPLAY DEVICE

This application claims the benefit of Korean Patent Application No. 10-2011-0121137 filed on Nov. 18, 2011, which is incorporated by reference herein in its entirety.

BACKGROUND

1. Technical Field

This document relates to an organic light emitting diode display device capable of compensating the threshold voltage of a driving TFT.

2. Description of the Related Art

The demand for various types of display devices for displaying an image is increasing. Various flat panel displays, such as a liquid crystal display, a plasma display panel, and an organic light emitting diode (OLED) display, have been recently used. Out of the various types of flat panel displays, the OLED display has excellent characteristics including a low voltage drive, a thin profile, a wide viewing angle, and a fast response time. Especially, an active matrix type OLED display for displaying an image on a plurality of pixels, which are arranged in a matrix form, has been widely used.

A display panel of the active matrix type OLED display comprises a plurality of pixels arranged in a matrix form. Each of the pixels comprises a scan thin film transistor (TFT) for supplying a data voltage of a data line in response to a scan signal of a scan line and a driving TFT for adjusting the amount of current supplied to an organic light emitting diode in accordance with a data voltage supplied to a gate electrode. The drain-source current Ids of the driving TFT supplied to the organic light emitting diode can be represented by Equation 1:

$$I_{ds}=k'\cdot(V_{gs}-V_{th})^2 \quad \text{[Equation 1]}$$

where k' represents a proportionality coefficient determined by the structure and physical properties of the driving TFT, Vgs represents the gate-source voltage of the driving TFT, and Vth represents the threshold voltage of the driving TFT.

The threshold voltage Vth of the driving TFT of each of the pixels may have a different value due to a shift in the threshold voltage Vth caused by degradation of the driving TFT. In this case, the drain-source current Ids of the driving TFT depends upon the threshold voltage Vth of the driving TFT. Hence, the current Ids supplied to the organic light emitting diode differs from pixel to pixel even if the same data voltage is supplied to each of the pixels. Accordingly, there arises the problem that the luminance of light emitted from the organic light emitting diode of each of the pixels differs even if the same data voltage is supplied to each of the pixels. To solve this problem, various types of pixel structures for compensating the threshold voltage Vth of the driving TFT have been proposed.

FIG. 1 is a circuit diagram showing a part of a diode-coupled threshold voltage compensation pixel structure. FIG. 1 depicts a driving TFT DT supplying current to an organic light emitting diode and a sensing TFT ST coupled between a gate node Ng and drain node Nd of the driving TFT DT. The sensing TFT ST allows for a connection between the gate node Ng and drain node Nd of the driving TFT DT during a threshold voltage sensing period of the driving TFT DT so that the driving TFT DT is driven by a diode. In FIG. 1, the driving TFT DT and the sensing TFT ST are illustrated as N-type MOSFET (Metal Oxide Semiconductor Field Effect Transistors).

Referring to FIG. 1, the gate node Ng and the drain node Nd are coupled during the threshold voltage sensing period in which the sensing TFT ST is turned on, thereby allowing the gate node Ng and the drain node Nd to float at substantially the same potential. If a voltage difference Vgs between the gate node Ng and a source node Ns is greater than a threshold voltage, the driving TFT DT forms a current path until the voltage difference Vgs between the gate node Ng and the source node Ns reaches the threshold voltage Vth of the driving TFT DT, and as a result, the voltage of the gate node Ng and the drain node Nd is discharged. However, if the threshold voltage Vth of the driving TFT DT is shifted to a negative voltage, the voltage difference Vgs between the gate node Ng and the source node Ns cannot reach the threshold voltage Vth of the driving TFT DT, even if the gate node Ng goes down to 0 V, because the threshold voltage Vth of the driving TFT DT is lower than 0 V. Consequently, if the threshold voltage Vth of the driving TFT DT is shifted to a negative voltage, the threshold voltage Vth of the driving TFT DT cannot be sensed. A negative shift refers to shifting the threshold voltage Vth of the driving TFT DT to a voltage lower than 0 V when the driving TFT DT is implemented as an N-type MOSFET. The negative shift often occurs when a semiconductor layer of the driving TFT DT is formed of an oxide.

SUMMARY

The present invention has been made in an effort to provide an organic light emitting diode display device capable of sensing the threshold voltage of a driving TFT even when the threshold voltage of the driving TFT is shifted to a negative voltage.

An organic light emitting diode display device according to the present invention comprises: a display panel having a data line, a scan line, and an emission line formed thereon and a plurality of pixels arranged in a matrix form, each of the pixels comprising: a driving TFT comprising a gate electrode coupled to a first node, a source electrode coupled to a second node, and a drain electrode coupled to a high-potential voltage source supplying a high-potential voltage; an organic light emitting diode comprising an anode coupled to the second node and a cathode coupled to a low-potential voltage source supplying a low-potential voltage; a first TFT that is turned on in response to a scan signal having a first logic level voltage of the first scan line to connect the first node to the data line; a second TFT that is turned in response to an emission signal having the first logic level voltage of the emission line to connect the second node to the third node; a first capacitor coupled between the first node and the third node; and a second capacitor coupled between the third node and a reference voltage source supplying a reference voltage.

The features and advantages described in this summary and the following detailed description are not intended to be limiting. Many additional features and advantages will be apparent to one of ordinary skill in the art in view of the drawings, specification and claims.

BRIEF DESCRIPTION OF THE DRAWINGS

FIG. 4 is a table showing changes in the voltages of nodes of a pixel;

DETAILED DESCRIPTION

Figure 1:
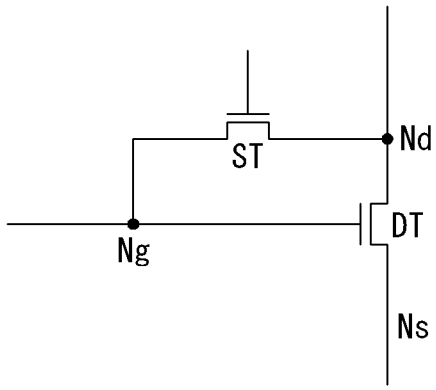
FIG. 1 is a circuit diagram showing a part of a diode-connected threshold voltage compensation pixel structure.

The invention will be described more fully hereinafter with reference to the accompanying drawings, in which embodiments of the invention are shown. The invention may, however, be embodied in many different forms and should not be construed as limited to the embodiments set forth herein. Like reference numerals designate like elements throughout the specification. In the following description, if it is decided that the detailed description of known function or configuration related to the invention makes the subject matter of the invention unclear, the detailed description is omitted.

A pixel of an organic light emitting diode display device according to an embodiment of the present invention can internally compensate the threshold voltage of a driving TFT and externally compensate the threshold voltage and electron mobility of the driving TFT and the threshold voltage of an organic light emitting diode. Internal compensation refers to sensing and compensating the threshold voltage of the driving TFT in real time within the pixel. External compensation refers to sensing the drain-source current of the driving TFT and the current of the organic light emitting diode, using the sensed current to compensate digital video data to be supplied to the pixel, and then supplying the compensated digital video data to the pixel. Particularly, the external compensation allows for real-time compensation of the threshold voltage and electron mobility of driving TFTs of pixels coupled to a scan line and the threshold voltage of organic light emitting diodes of the pixels, by sensing the drain-source current of the driving TFTs of the pixels coupled to the scan line or the current of the organic light emitting diodes of the pixels every frame period.

Figure 2:
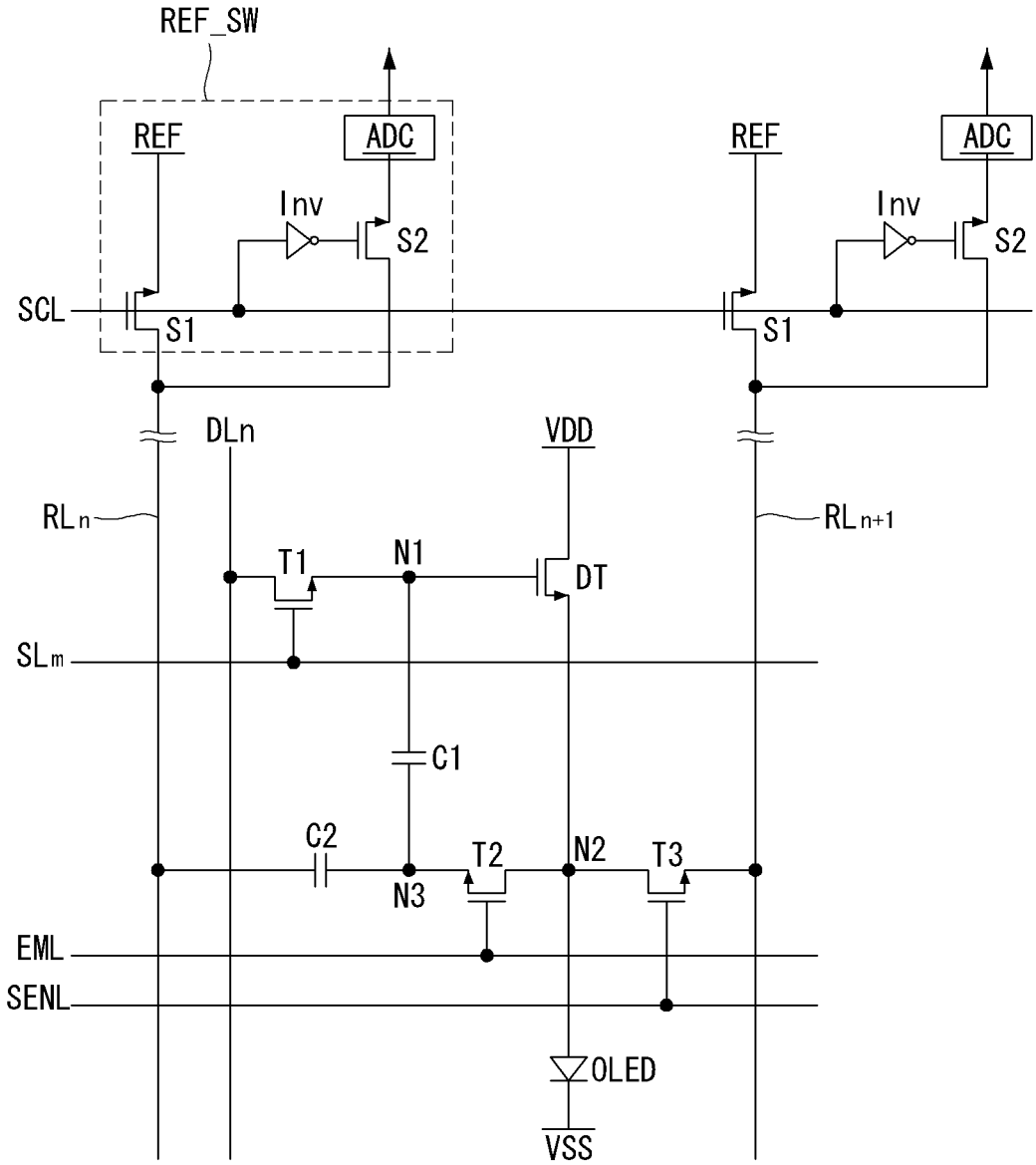
FIG. 2 is an equivalent circuit diagram of a pixel according to a first embodiment of the present invention.

FIG. 2 is an equivalent circuit diagram of a pixel according to a first embodiment of the present invention. Referring to FIG. 2, the pixel P according to the first embodiment comprises a driving TFT (thin film transistor) DT, an organic light emitting diode OLED, a control circuit, capacitors, and a reference voltage switching circuit REF_SW.

The driving TFT DT adjusts the amount of drain-source current Ids to differ according to the level of a voltage applied to a gate electrode. The gate electrode of the driving TFT DT is coupled to a first node N1, a source electrode thereof is coupled to a second node N2, and a drain electrode thereof is coupled to a high-potential voltage source supplying a high-potential voltage VDD.

An anode of the organic light emitting diode is coupled to the second node N2, a cathode thereof is coupled to a low-potential voltage source supplying a low-potential voltage VSS. The organic light emitting diode OLED emits light depending on the drain-source current Ids of the driving TFT DT.

The control circuit comprises first to third TFTs T1, T2, and T3. The first TFT T1 is turned on in response to an mth scan signal SCANm having a gate high voltage VGH supplied from an mth (m is a natural number) scan line SLm for coupling the first node N1 and an nth data line DLn to supply a data voltage Dn to node N1. A gate electrode of the first TFT T1 is coupled to the mth scan line SLm, a source electrode thereof is coupled to the first node N1, and a drain electrode thereof is coupled to the nth data line DLn.

The second TFT T2 is turned on in response to an emission signal EM having the gate high voltage VGH supplied from an emission line EML for coupling the second node N2 and the third node N3. A gate electrode of the second TFT T2 is coupled to the emission line EML, a source electrode thereof is coupled to the third node N3, and a drain electrode thereof is coupled to the second node N2.

The third TFT T3 is turned on in response to a sensing signal SEN having the gate high voltage VGH supplied from a sensing line SENL for coupling the second node N2 and an (n+1)th reference voltage line RLn+1. The (n+1)th reference voltage line RLn+1 is coupled to a reference voltage source supplying a reference voltage REF. A gate electrode of the third TFT T3 is coupled to the sensing line SENL, a source electrode thereof is coupled to the (n+1)th reference voltage line RLn+1, and a drain electrode thereof is coupled to the second node N2.

The first capacitor C1 is coupled between the first node N1 and the third node N3, and is charged to store a differential voltage between the first node N1 and the third node N3. The second capacitor C2 is coupled between the nth reference voltage line RLN and the third node N3, and is charged to store a differential voltage between the nth reference voltage line RLn and the third node N3.

The first node N1 is a contact point at which the gate electrode of the driving TFT DT, the source electrode of the first TFT T1, and one electrode of the first capacitor C1 are coupled. The second node N2 is a contact point at which the source electrode of the driving TFT DT, the drain electrode of the second TFT T2, the drain electrode of the third TFT T3, and the anode of the organic light emitting diode are coupled. The third node N3 is a contact point at which the source electrode of the second TFT T2, the other electrode of the first capacitor C1, and one electrode of the second capacitor C2 are coupled. The other electrode of the second capacitor C2 is coupled to the nth reference voltage line RLn.

Semiconductor layers of the first to third TFTs T1, T2, and T3 and the driving TFT DT have been described as being formed of an oxide semiconductor. However, the present invention is not limited thereto, but the semiconductor layers of the first to third TFTs T1, T2, and T3 and the driving TFT DT may be formed of either a-Si or Poly-Si. Also, embodiments of the present invention are described with respect to examples in which the first to third TFTs T1, T2, and T3 and the driving TFT DT are implemented as N-type MOSFETs (Metal Oxide Semiconductor Field Effect Transistors).

After consideration of the characteristics of the driving TFT DT and the characteristics of the organic light emitting diode OLED, the high-potential voltage source is set to supply a high-potential voltage VDD swinging among a high level VDD_H, a middle level VDD_M, and a low level VDD_L, and the low-potential voltage source is set to supply a DC low-potential voltage VSS. The reference voltage REF may be set to a predetermined DC voltage. For example, a high-potential voltage VDD_H of high level may be set to 20 V, the high-potential voltage VDD_L of low level may be set to approximately −7 V, the low-potential voltage VSS may be set to 0 V, and the reference voltage REF may be set to approximately 0 V.

An organic light emitting diode display according to the present invention further comprises a reference voltage switching circuit REF_SW to externally compensate the threshold voltage Vth and electron mobility of the driving TFT DT and the threshold voltage of the organic light emitting diode OLED. The reference voltage switching circuit REF_SW comprises first and second switches S1 and S2, an inverter Inv, and a current sensing circuit ADC. It should be noted that, although the first and second switches S1 and S2 have been described as being implemented as N-type MOSFETs, the present invention is not limited thereto. The reference voltage switching circuit REF SW causes the reference voltage lines RLn and RLn+1 to be coupled to the reference voltage source during second to fifth periods for internal compensation, and causes the reference voltage lines RLn and RLn+1 to be coupled to the current sensing circuit ADC during a first period for sensing current for external compensation.

The first switch S1 of each reference voltage switching circuit REF_SW is turned on in response to a switching control signal SC having a gate high voltage VGH supplied from a switching control line SCL being true. The first switch S1, when on, couples the reference voltage lines RLn to the reference voltage source supplying a reference voltage REF. A gate electrode of the first switch S1 is coupled to the switching control line SCL, a source electrode thereof is coupled to the reference voltage source, and a drain electrode thereof is coupled to the reference voltage lines RLn.

The second switch S2 of each reference voltage switching circuit REF_SW is turned on in response to the complement of the gate high voltage VGH of the switching control signal SC supplied from the switching control line SCL being true when inverted by an inverter Inv. In other words, the second switch S2 turns on in response to a gate low voltage VGL of the switching control signal SC. The second switch S2, when on, couples the reference voltage lines RLn to the current sensing circuit ADC. A gate electrode of the second switch S2 is coupled to the inverter, a source electrode thereof is coupled to the current sensing circuit ADC, and a drain electrode thereof is coupled to the reference voltage lines RLn.

The inverter Inv inverts the switching control signal SC supplied from the switching control line SCL to generate a complement of the switching control signal SC. The inverter Inv is coupled between the switching control line SCL and the gate electrode of the second switch S2.

The current sensing circuit ADC is coupled to the reference voltage lines RLn and RLn+1 during the first period to sense the current flowing through the reference voltage lines RLn and RLn+1. The current sensing circuit ADC converts sensed current into digital data, and outputs the converted digital data to a timing controller 40.

Figure 3:
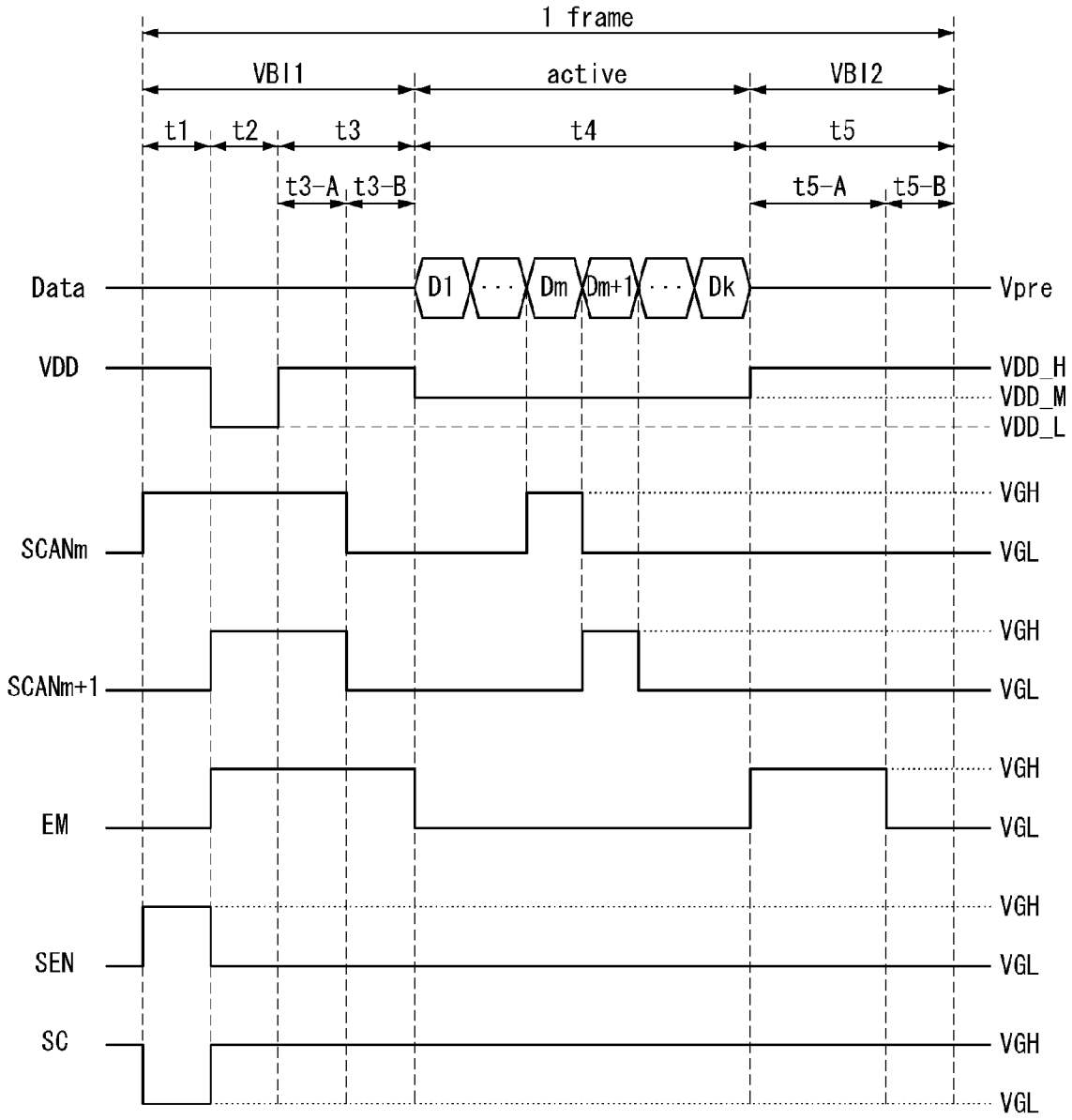
FIG. 3 is a waveform diagram showing signals which are input into a pixel to make internal compensation according to a first embodiment of the present invention.

FIG. 3 is a waveform diagram showing signals which are input into a pixel to make internal compensation according to a first embodiment of the present invention. FIG. 3 depicts a data voltage DATA, a high-potential voltage VDD, scan signals SCANm and SCANm+1, an emission signal EM, a sensing signal SEN, and a switching control signal SC which are input into the display panel 10 during one frame period for internal compensation.

Referring to FIG. 3, the scan signals SCANm, and SCANm+1, the emission signal EM, and the sensing signal SEN are signals for controlling the first to third TFTs T1, T2, and T3 of the pixel P. The switching control signal is a signal for controlling the first and second switches S1 and S2 of the reference voltage switching circuit REF_SW.

The high-potential voltage VDD, the scan signals SCANm and SCANm+1, the emission signal EM, the sensing signal SEN, and the switching control signal SC are generated every frame period. One frame period comprises a first vertical blank interval VBI1, an active interval, and a second vertical blank interval VBI2. The active interval refers to an interval for supplying an effective data voltage DATA to the display panel 10, the first vertical blank interval VBI1 refers to a blank interval before the active interval, and the second vertical interval VBI2 refers to a blank interval after the active interval. The data voltage DATA is generated every horizontal period 1H during the active interval. One horizontal period 1H refers to one line scanning period in which data is written in pixels of one horizontal line in the display panel 10.

The data voltage DATA is generated during the active interval in synchronization with the scan signals SCANm and SCANm+1. It should be noted that FIG. 3 illustrates first to kth data voltages D1 to Dk (k is a natural number indicating the number of scan lines of the display panel 10) supplied to a certain data line for convenience of explanation. The scan signals SCANm and SCANm+1 are sequentially generated during the active interval. It should be noted that FIG. 3 illustrates only first, second, and kth scan signals supplied to first, second, and kth scan lines for convenience of explanation.

Firstly, the data voltage DATA, high-potential voltage VDD, scan signals SCANm and SCANm+1, emission signal EM, sensing signal SEN, and switching control signal SC which are input into the display panel 10 during the first vertical blank interval VBI1 will be described. The first vertical blank interval VBI1 may be divided into first to third periods t1, t2, and t3. The data voltage DATA is generated at a preset voltage Vpre during the first to third periods t1, t2, and t3. The high-potential voltage VDD is generated at a high level VDD_H during the first and third periods t1 and t3 and at a low level VDD_L during the second period t2. The emission signal EM is generated at a gate low voltage VGL during the first period t1 and at a gate high voltage VGH during the second and third periods t2 and t3. The sensing signal SEN is generated at the gate high voltage VGH during the first period t1 and at the gate low voltage VGL during the second and third periods t2 and t3. The switching control signal SC is generated at the gate low voltage VGL during the first period t1 and at the gate high voltage VGH during the second and third periods t2 and t3. Meanwhile, in the description, a first logic level voltage is exampled as the gate high voltage VGH, and a second logic level voltage may is exampled as the gate low voltage VGL.

The organic light emitting diode display device of the present invention externally compensates the threshold voltage and electron mobility of driving TFTs of pixels coupled to one scan line or the threshold voltage of organic light emitting diodes of the pixels every frame period. FIG. 3 is described with respect to an example in which the drain-source current Ids of driving TFTs of pixels coupled to an mth scan line SLm or the current Ioled of organic light emitting diodes of the pixels is sensed and used to make external compensation. In this case, the mth scan signal SCANm supplied to the mth scan line SLm for which compensation is be made, out of the scan signals SCANm and SCANm+1, is generated at the gate high voltage VGH during the first and second periods t1 and t2 and an A part t3-A of the third period t3 and at the gate low voltage VGL during a B part t3-B of the third period t3. The gate high voltage VGH may be set to approximately between 14 V to 20 V, and the gate low voltage VGL may be set to approximately between −12 V and −5 V.

Secondly, the data voltage DATA, high-potential voltage VDD, scan signals SCANm and SCaNm+1, emission signal EM, sensing signal SEN, and switching control signal SC which are input into the display panel 10 during the active interval will be described. The active interval is an interval in which data voltages are written (e.g., sequentially) into pixels P of the display panel 10. The active interval may be defined as a fourth period t4. The data voltage DATA is generated every horizontal period 1H during the fourth period t4. The high-potential voltage VDD is generated at a middle level VDD_M during the fourth period t4. The reason why the high-potential voltage VDD is generated at the middle level VDD_M during the fourth period t4 is to prevent an organic light emitting diode OLED from emitting light by the turning-on of a driving TFT DT. As a result, light emission of the organic light emitting diode OLED can be prevented by generating the high-potential voltage VDD at the middle level VDD_M during the fourth period t4, thereby achieving a higher contrast ratio.

The scan signals SCANm and SCANm+1 are generated at the gate high voltage VGH in synchronization with the data voltage DATA during the fourth period t4. That is, the mth scan signal SCANm is generated at the gate high voltage VGH during a period for synchronization with an mth data voltage Dm and at the gate low voltage VGL during the remaining period. The (m+1)th scan signal SCANm+1 is generated at the gate high voltage during a period for synchronization with an (m+1)th data voltage Dm+1 and at the gate low voltage VGL during the remaining period. The emission signal EM is generated at the gate low voltage VGL during the fourth period t4. The switching control signal SC is generated at the gate high voltage VGH during the fourth period t4.

Thirdly, the data voltage DATA, high-potential voltage VDD, scan signals SCANm and SCANm+1, emission signal EM, sensing signal SEN, and switching control signal SC which are input into the display panel 10 during the second vertical blank interval VBI2 will be described. The second vertical blank interval VBI2 corresponds to a fifth period t5. The data voltage DATA is generated at the preset voltage Vpre during the fifth period t5. The high-potential voltage VDD is generated at the high level VDD_H during the fifth period t5. The scan signals SCANm and SCANm+1 are generated at the gate low voltage VGL during the fifth period t5. The emission signal EM is generated at the gate high voltage VGH during an A part t5-A of the fifth period t5 and at the gate low voltage VGL during a B part t5-B of the fifth period t5. The sensing signal SEN is generated at the gate low voltage VGL during the fifth period t5. The switching control signal SC is generated at the gate high voltage VGH during the fifth period t5.

FIG. 4 is a table showing changes in the voltages of nodes of a pixel. Hereinafter, an operation of the pixel P during the first to fifth periods t1 to t5 will be described in detail with reference to FIGS. 2 to 4. The first period t1 is a period for sensing current for external compensation, the second period t2 is a period during which the first to third nodes N1, N2, and N3 are initialized, the second period t2 is subsequent to the first period t1, the third period t3 is subsequent to the second period t2, the fourth period t4 is subsequent to the third period t3, and the fifth period t5 is subsequent to the fourth period t4. The third period t3 is divided into the A part t3-A and the B part t3-B, and the fifth period t5 is divided into the A part t5-A and the B part t5-B.

Firstly, during the first period t1, the mth scan signal SCANm having the gate high voltage VGH is supplied through the mth scan line SLm, and the emission signal EM having the gate low voltage VGL is supplied through the emission line EML. During the first period t1, the sensing signal SEN having the gate high voltage VGH is supplied through the sensing line SENL, and the switching control signal SC having the gate low voltage VGL is supplied through the switching control line SCL. Also, during the first period t1, the data voltage DATA of the preset voltage Vpre is supplied through the nth data line DLn, and the high-potential voltage VDD_H of high level is supplied from the high-potential voltage source.

The first switch S1 is turned off in response to the switching control signal SC having the gate low voltage VGL. The second switch S2 is turned on in response to the inverter Inv inverting the gate low voltage VGL of the switching control signal SC to couple the current sensing circuit ADC to the (n+1)th reference voltage line RLn+1. By the turning-off of the first switch S1 and the turning-on of the second switch S2, the (n+1)th reference voltage line RLn+1 is disconnected from the reference voltage source, and connected to the current sensing circuit ADC.

The first TFT T1 is turned on in response to the mth scan signal SCANm having the gate high voltage VGH to connect the first node N1 to the nth data line DLn. The second TFT T2 is turned off in response to the emission signal EM having the gate low voltage VGL. The third TFT T3 is turned on response to the sensing signal SEN having the gate high voltage VGH to connect the second node N2 to the (n+1)th reference voltage line RLn+1.

Figure 5:
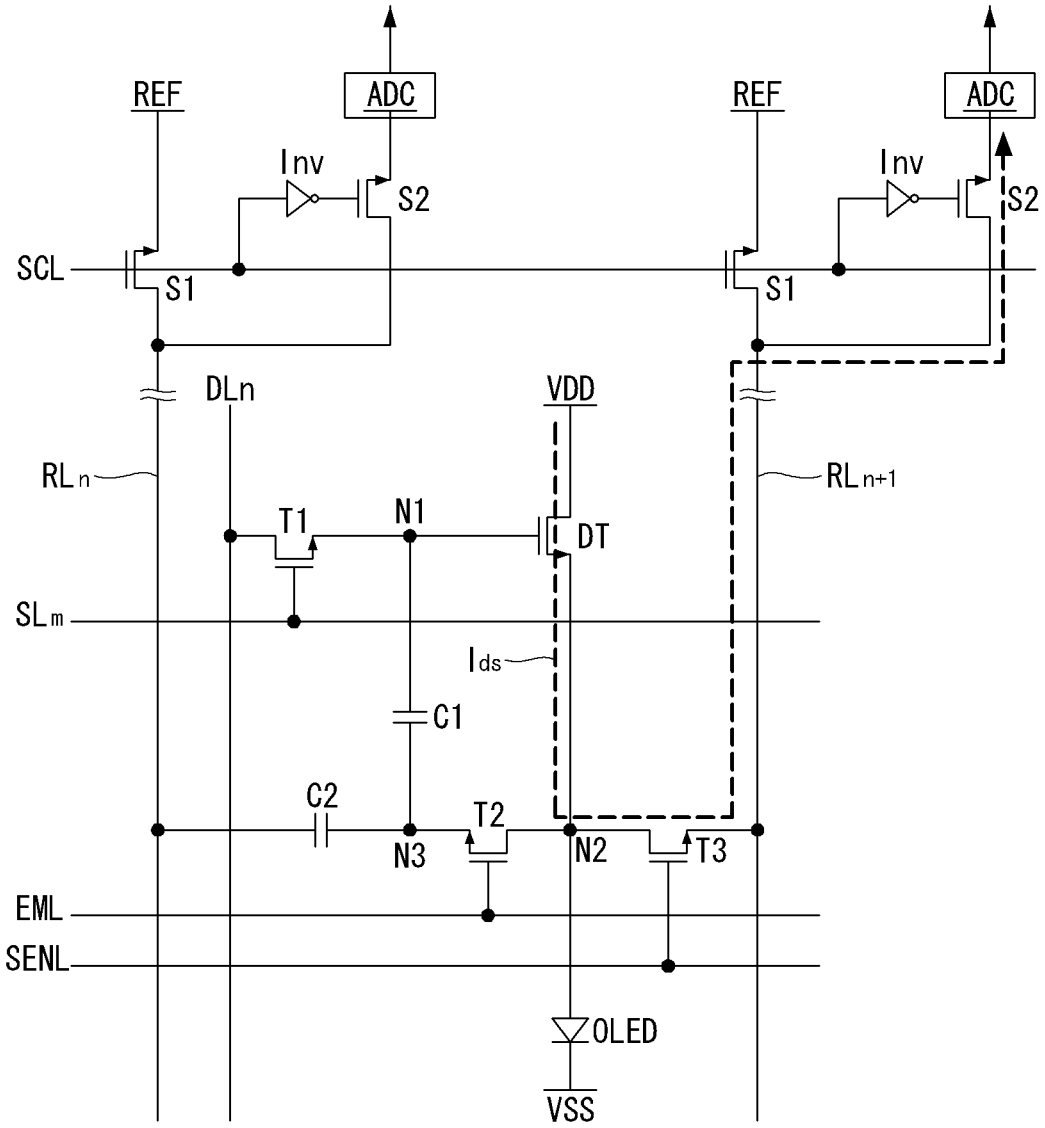
FIG. 5 is a view showing a current flow through a pixel in the case of sensing the drain-source current of a driving TFT.

During the first period t1, the preset voltage Vpre of the nth data line DLn is supplied to the first node N1 by the turning-on of the first TFT T1. In the case of sensing the drain-source current Ids of the driving TFT DT, the preset voltage Vpre applied during the first period t1 needs to be a voltage enough to turn on the driving TFT DT. That is, the preset voltage Vpre is applied such that a voltage difference Vgs between the preset voltage Vpre, which is the voltage of the gate electrode of the driving TFT DT, and the high-potential voltage VDD, which is the voltage of the source electrode thereof, is greater than a threshold voltage Vth. In this case, as shown in FIG. 5, the drain-source current Ids of the driving TFT DT flows toward the current sensing circuit ADC through the driving TFT DT, the second node N2, the third TFT T3, and the (n+1)th reference voltage line RLn+1. Accordingly, the current sensing circuit ADC can sense the drain-source current Ids of the driving TFT DT.

Figure 6:
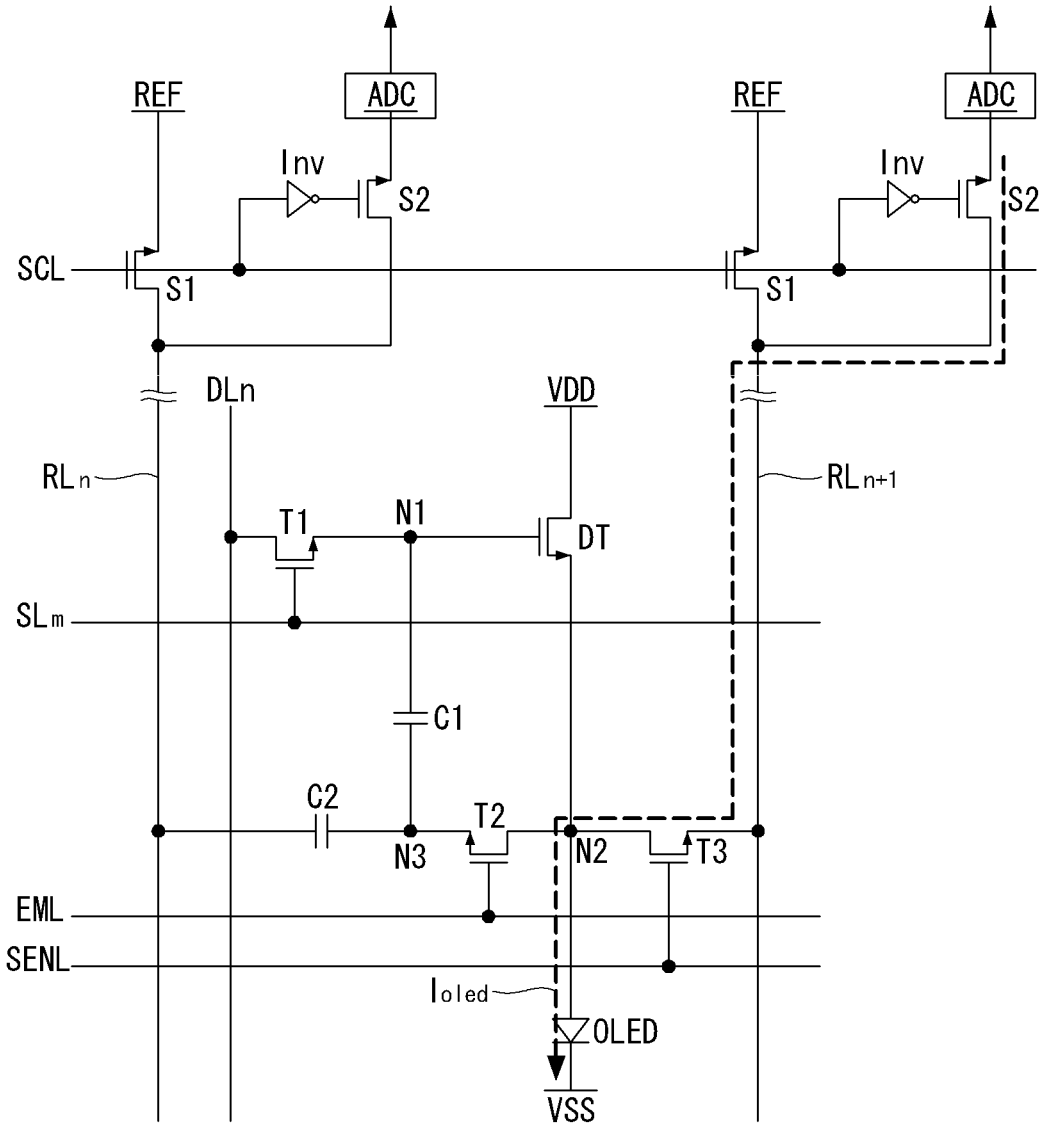
FIG. 6 is a view showing a current flow through a pixel in the case of sensing the current of an organic light emitting diode.

Moreover, in the case of sensing the current Ioled of the organic light emitting diode OLED, the preset voltage Vpre applied during the first period t1 should be set at a level to turn off the driving TFT DT. That is, the preset voltage Vpre is applied at a level such that a voltage difference Vgs between the preset voltage Vpre, which is the voltage of the gate electrode of the driving TFT DT, and the high-potential voltage VDD, which is the voltage of the source electrode thereof, is less than a threshold voltage Vth. In this case, as shown in FIG. 6, the current Ioled of the organic light emitting diode OLED flows toward the low-potential voltage source the current sensing circuit ADC, the (n+1)th reference voltage line RLn+1, the third TFT T3, the second node N2, and the organic light emitting diode OLED. Accordingly, the current sensing circuit ADC can sense the current Ioled of the organic light emitting diode OLED.

Secondly, during the second period t2, the mth scan signal SCANm having the gate high voltage VGH is supplied through the mth scan line SLm, and the emission signal EM having the gate high voltage VGH is supplied through the emission line EML. During the second period t2, the sensing signal SEN having the gate low voltage VGL is supplied through the sensing line SENL, and the switching control signal SC having the gate high voltage VGH is supplied through the switching control line SCL. Also, during the second period t2, the data voltage DATA of the preset voltage Vpre is supplied through the nth data line DLn, and the high-potential voltage VDD_L of low level is supplied from the low-potential voltage source.

The first switch S1 is turned on in response to the switching control signal SC having the gate high voltage VGH to connect the reference voltage source to the (n+1)th reference voltage line RLn+1. The second switch S2 is turned off in response to an inverted signal of the switching control signal SC. By the turning-on of the first switch S1 and the turning-off of the second switch S2, the (n+1)th reference voltage RLn+1 is uncoupled from the current sensing circuit ADC and coupled to the reference voltage source.

The first TFT T1 is turned on in response to the mth scan signal SCANm having the gate high voltage VGH to couple the first node N1 to the nth data line DLn. The second TFT T2 is turned on in response to the emission signal EM having the gate high voltage VGH to connect the second node N2 to the third node N3. The third TFT T3 is turned off in response to the sensing signal SEN having the gate low voltage VGL.

During the second period t2, the preset voltage Vpre of the nth data line DLn is supplied to the first node N1 by the turning-on of the first TFT T1. Because the high-potential voltage VDD_L of low level is supplied from the high-potential voltage source during the second period t2, the drain electrode of the driving TFT DT coupled to the high-potential voltage source functions as a source electrode, and the source electrode of the driving TFT DT coupled to the second node N2 functions as a drain electrode. Accordingly, the voltage difference Vgs between the gate and source electrodes of the driving TFT is greater than the threshold voltage Vth during the period t2, thereby turning on the driving TFT DT. By the turning-on of the driving TFT DT is turned on, the second node N2 is discharged to the high-potential voltage VDD_L of low level. Moreover, by the turning-on of the third TFT T3, the third node N3 coupled to the second node N2 is also discharged to the high-potential voltage VDD_L of low level.

Thirdly, the mth scan signal SCANm having the gate high voltage VGH is supplied through the mth scan line SLm during the A part t3-A of the third period t3, and the mth scan signal SCANm having the gate low voltage VGL is supplied through the mth scan line SLm during the B part t3-B of the third period t3. Also, during the third period t3, the emission signal EM having the gate high voltage VGH is supplied through the emission line EML, the sensing signal SEN having the gate low voltage VGL is supplied through the sensing line SENL, and the switching control signal SC having the gate high voltage VGH is supplied through the switching control line SCL. Also, during the third period t3, the data voltage DATA of the preset voltage Vpre is supplied through the nth data line DLn, and the high-potential voltage VDD_H of high level is supplied from the high-potential voltage source.

The first switch S1 is turned on in response to the switching control signal SC having the gate high voltage VGH to couple the reference voltage source to the (n+1)th reference voltage line RLn+1. The second switch S2 is turned off in response to the inverted signal of the switching control signal SC. By the turning-on of the first switch S1 and the turning-off of the second switch S2, the (n+1)th reference voltage line RLn+1 is uncoupled from the current sensing circuit ADC and coupled to the reference voltage source.

The first TFT T1 is turned on in response to the mth scan signal SCANm having the gate high voltage VGH during the A part t3-A of the third period t3, and turned off in response to the mth scan signal SCANm having the gate low voltage VGL during the B part t3-B of the third period t3. The second TFT T2 is turned on in response to the emission signal EM having the gate high voltage VGH to connect the second node N2 to the third node N3. The third TFT T3 is turned off in response to the sensing signal SEN having the gate low voltage VGL.

The high-potential voltage VDD_H of high level is supplied from the high-potential voltage source during the third period t3. Because the voltage difference Vgs between the gate and source electrodes of the driving TFT DT is greater than the threshold voltage Vth, the driving TFT DT forms a current path until the voltage difference Vgs between the gate and source electrodes reaches the threshold voltage Vth. Accordingly, the voltage of the second node N2 rises up to a differential voltage Vpre-Vth between the preset voltage Vpre and the threshold voltage Vth of the driving TFT DT. Moreover, as the third node N3 is coupled to the second node N2 by the turning-on of the third TFT T3, the voltage of the third node N3 rises up to the differential voltage Vpre-Vth between the preset voltage Vpre and the threshold voltage Vth of the driving TFT DT.

The B part t3-B of the third period t3 may be defined as a floating period of the first node N1. As the first node N1 floats during the B part t3-B of the third period t3, a change in the voltage of the second node N2 may be applied to the first node N1 by a parasitic capacitance existing between the gate electrode and source electrode of the driving TFT DT. Due to this, the voltage of the first node N1 is increased, thereby enhancing the sensing speed of the threshold voltage Vth of the driving TFT DT.

Consequently, the second node N2 and the third node N3 sense the threshold voltage Vth of the driving TFT DT during the third period t3. That is, the third period t3 may be appropriately set to approximately two or more horizontal periods by a preliminary test. A detailed description thereof will be described later with reference to FIG. 5. The threshold voltage Vth of the driving TFT DT may be sensed during two or more horizontal periods, and therefore the accuracy of sensing the threshold voltage of the driving TFT DT can be increased even when a large area, high-resolution organic light emitting diode display device is driven at high speed at a frame frequency of 240 Hz or more.

Fourthly, during the fourth period t4, the mth scan signal SCANm having the gate high voltage VGH to be synchronized with the mth data voltage Dm is supplied through the mth scan line SLM, and the emission signal EM having the gate low voltage VGL is supplied thorough the emission line EML. During the fourth period t4, the sensing signal SEN having the gate low voltage VGL is supplied through the sensing line SENL, and the switching control signal SC having the gate high voltage VGH is supplied through the switching control line SCL. Also, during the fourth period t4, the data voltage DATA comprising the first to kth data voltages D1 to Dk is supplied through the nth data line DLn, and the high-potential voltage VDD_M of middle level is supplied from the high-potential voltage source.

The first switch S1 is turned on in response to the switching control signal SC having the gate high voltage VGH to couple the reference voltage source to the (n+1)th reference voltage line RLn+1. The second switch S2 is turned off in response to the inverted signal of the switching control signal SC. By the turning-on of the first switch S1 and the turning-off of the second switch S2, the (n+1)th reference voltage line RLn+1 is decoupled from the current sensing circuit ADC and coupled to the reference voltage source.

The first TFT T1 is turned on in response to the mth scan signal SCANm having the gate high voltage VGH during a period for synchronization with the mth data voltage Dm in the fourth period t4. The second TFT T2 is turned off in response to the emission signal EM having the gate low voltage VGL. The third TFT T3 is turned off in response to the sensing signal SEN having the gate low voltage VGL.

By the turning-on of the first TFT T1, the first node N1 is charged with the data voltage DATA. The third TFT T3 is turned off by the emission signal EM having the gate low voltage VGL. By the turning-off of the third TFT T3, the second node N2 is decoupled from the third node N3, and the third node N3 floats. As the third node N3 floats during t4, a change in the voltage of the first node N1 is applied to the third node N3 by the first capacitor C1.

That is, 'Vpre-DATA, the change in the voltage of the first node N1, is applied to the third node N3. However, the third node N3 is coupled between the first and second capacitors C1 and C2 coupled in series. Hence, the voltage change is applied in the ratio of C' as shown in Equation 2:

$$C' = \frac{CA1}{CA1 + CA2} \quad \text{[Equation 2]}$$

where CA1 represents the capacitance of the first capacitor C1, and CA2 represents the capacitance of the second capacitor C2. As a consequence, 'C'(Vpre-DATA)' is applied to the third node N3, and therefore the voltage of the third node N3 is changed to 'Vpre-Vth-C'(Vpre-DATA)'.

Fifthly, the mth scan signal SCANm having the gate low voltage VGL is supplied through the mth scan line SLm during the fifth period t5. Also, the emission signal EM having the gate high voltage VGH is supplied through the emission line EML during the A part t5-A of the fifth period t5, and the emission signal EM having the gate low voltage VGL is supplied through the emission line EML during the B part t5-B of the fifth period t5. Also, during the fifth period t5, the sensing signal having the gate low voltage VGL is supplied through the sensing line SENL, and the switching control signal SC having the gate high voltage VGH is supplied through the switching control line SCL. Also, during the fifth period t5, the data voltage DATA of the preset voltage Vpre is supplied through the nth data line DLn, and the high-potential voltage VDD_H of high level is supplied from the high-potential voltage source.

The first switch S1 is turned on in response to the switching control signal SC having the gate high voltage VGH to couple the reference voltage source to the (n+1)th reference voltage line RLn+1. The second switch S2 is turned off in response to the inverted signal of the switching control signal SC. By the turning-on of the first switch S1 and the turning-off of the second switch S2, the (n+1)th reference voltage line RLN+1 is decoupled from the current sensing circuit ADC and coupled to the reference voltage source.

The first TFT T1 is turned off in response to the mth scan signal SCANm having the gate low voltage VGL. The second TFT T2 is turned on in response to the emission signal EM having the gate high voltage VGH during the A part t5-A of the fifth period t5 to couple the second node N2 to the third node N3, and turned off in response to the emission signal EM having the gate low voltage VGL during the B part t5-B of the fifth period t5. The third TFT T3 is turned off in response to the sensing signal SEN having the gate low voltage VGL.

As the second node N2 is coupled to the third node N3 by the turning-on of the second TFT T2 during the A part t5-A of the fifth period t5, the voltage of the third node N3 rises up to the voltage Voled_anode of the second node N2. As the first node N1 floats during the fifth period t5 by the turning-off of the first TFT T1, a change in the voltage of the third node N3 is applied to the first node N1 by the first capacitor C1. That is, 'Vpre-Vth-C'(Vpre-DATA)-Voled_anode', the change in the voltage of the third node N3, is applied to the first node N1. Accordingly, the voltage of the first node N1 is changed to 'DATA-{Vrep-Vth-C'(Vrep-DATA)-Voled_anode}'.

The drain-source current Ids of the driving TFT DT supplied to the organic light emitting diode OLED is represented by Equation 3:

$$I_{ds}=k'\cdot(V_{gs}-V_{th})^2 \quad \text{[Equation 3]}$$

where k' represents a proportionality coefficient determined by the structure and physical properties of the driving TFT, depending on the electron mobility of the driving TFT DT, channel width, channel length, etc. Vgs represents the voltage difference between the gate and source electrodes of the driving TFT, and Vth represents the threshold voltage of the driving TFT DT. 'Vgs-Vth' during the A part t5-A of the fifth period t5 is as shown in Equation 4:

$$Vgs-Vth=[DATA-\{Vpre-Vth-C'(Vpre-\text{DATA})-V_{oled\ anode}\}-V_{oled\ anode}]-Vth \quad \text{[Equation 4]}$$

To sum up Equation 4, the drain-source current Ids of the driving TFT DT is derived as in Equation 5:

$$I_{ds}=k'[(1+C')\cdot(\text{DATA}-Vpre)]^2 \quad \text{[Equation 5]}$$

As a consequence, as shown in Equation 5, the drain-source current Ids of the driving TFT DT supplied to the organic light emitting diode OLED during t5 does not depend upon the threshold voltage Vth of the driving TFT DT. That is, the present invention makes it possible to compensate the threshold voltage of the driving TFT DT.

Overall, in the pixel P according to the first embodiment of the present invention, the high-potential voltage VDD is supplied at a low level VDD_L during an initialization period (t1) to initialize the second node N2 coupled to the source electrode of the driving TFT DT to the high-potential voltage VDD_L of low level. The high-potential voltage VDD_L of low level is set to a voltage lower than the differential voltage between the preset voltage Vpre and the threshold voltage Vth of the driving TFT DT. As a result, the pixel P according to the first embodiment of the present invention allows the voltage difference Vgs between the gate and source electrodes of the driving TFT DT to be larger than the threshold voltage Vth during the threshold voltage sensing period (t2), even if the threshold voltage Vth of the driving TFT DT is shifted to a negative voltage. Due to this, the driving TFT DT forms a current path until the voltage difference Vgs between the gate and source electrodes reaches the threshold voltage Vth. Accordingly, the voltage of the second node N2 rises up to a differential voltage REF1-Vth between a reference voltage REF and the threshold voltage Vth of the driving TFT DT. Therefore, even if the threshold voltage Vth of the driving TFT DT is shifted to a negative voltage, the second node N2 can sense the threshold voltage Vth. A negative shift refers to shifting the threshold voltage Vth of the driving TFT DT to a voltage lower than 0 V when the driving TFT DT is implemented as an N-type MOSFET.

Figure 7:
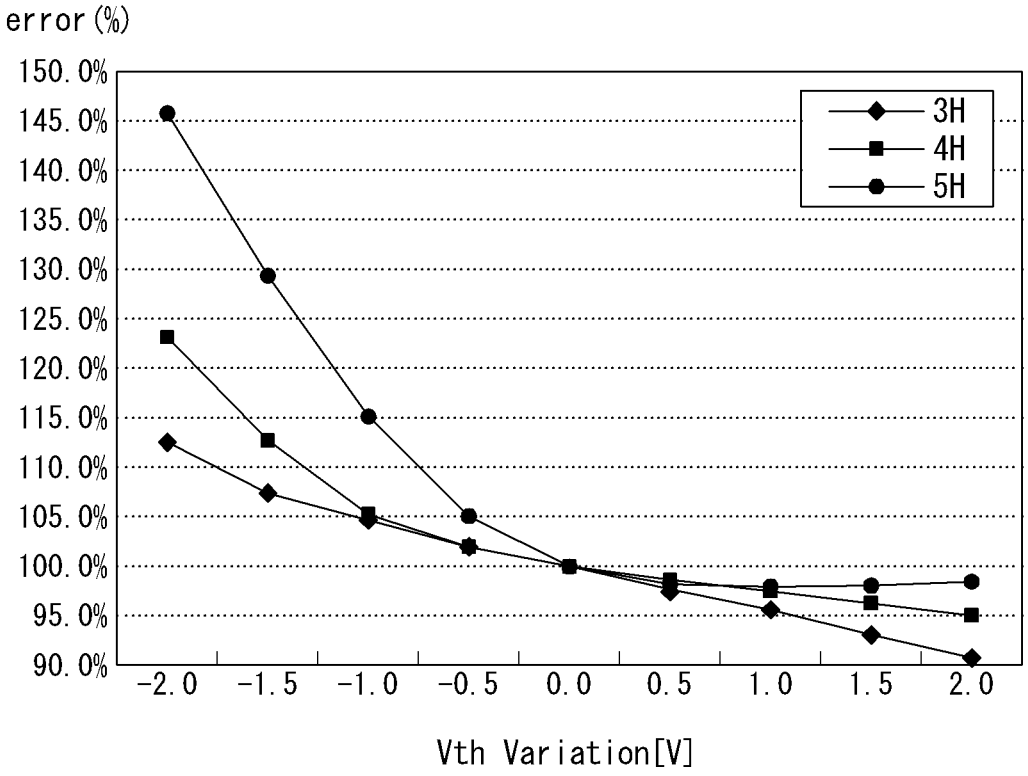
FIG. 7 is a graph showing a threshold voltage compensation error vs. a change in the threshold voltage of a driving TFT for each threshold voltage sensing period of the pixel according to the first embodiment of the present invention.

FIG. 7 is a graph showing a threshold voltage compensation error vs. a change in the threshold voltage of a driving TFT for each threshold voltage sensing period of the pixel according to the first embodiment of the present invention. Referring to FIG. 7, a threshold voltage variation range (Vth variation) of the driving TFT DT is shown on the x-axis, and an error of the drain-source current of the driving TFT DT supplied to the organic light emitting diode OLED is shown on the y-axis.

Due to degradation of the driving TFT, the threshold voltage Vth of the driving TFT DT may be shifted by −2.0 V to +2.0 V from the reference value for each pixel P. Accordingly, the organic light emitting diode display devices may allow the organic light emitting diode OLED to emit light, without depending on the threshold voltage Vth, by sensing the threshold voltage with of the driving TFT DT of each pixel P and compensating the threshold voltage Vth. However, if the accuracy of sensing the threshold voltage Vth of the driving TFT DT is low, the threshold voltage Vth sensed during the threshold voltage sensing period (t3) and an actual threshold voltage of the driving TFT DT are different. Thus, 'Vth' is not omitted from Equation 4. For this reason, an error occurs in the drain-source current Ids of the driving TFT DT supplied to the organic light emitting diode OLED.

FIG. 7 depicts an error in the drain-source current Ids of the driving TFT DT when a floating period (the B part t3-B of the third period) of the first node N, out of the threshold voltage sensing period (third period t3) of the driving TFT, corresponds to three to five horizontal periods 3H, 4H, and 5H. When the floating period (B part t3-B of the third period) of the first node N1 corresponds to three horizontal periods 3H, the error in the drain-source current Ids of the driving TFT DT occurs at about −10% to 12%, compared to a reference value of 100%. When the floating period (B part t3-B of the third period) of the first node N1 is equal to four horizontal periods 4H, the error in the drain-source current Ids of the driving TFT DT occurs at about −5% to 23%, compared to the reference value. When the floating period (B part t3-B of the third period) of the first node N1 is equal to five horizontal periods 5H, the error in the drain-source current Ids of the driving TFT DT occurs at about −3% to 45%, compared to the reference value.

The floating period (B part t3-B of the third period) of the first node N1 allows for improved sensing speed of the threshold voltage Vth of the driving TFT DT. Accordingly, in the first embodiment of the present invention, if the floating period (B part t3-B of the third period) of the first node N1 is set to three horizontal periods 3H, as shown in FIG. 7, the accuracy of sensing the threshold voltage of the driving TFT DT can be improved, and therefore an error in the drain-source current Ids of the driving TFT DT can be minimized.

Figure 8:
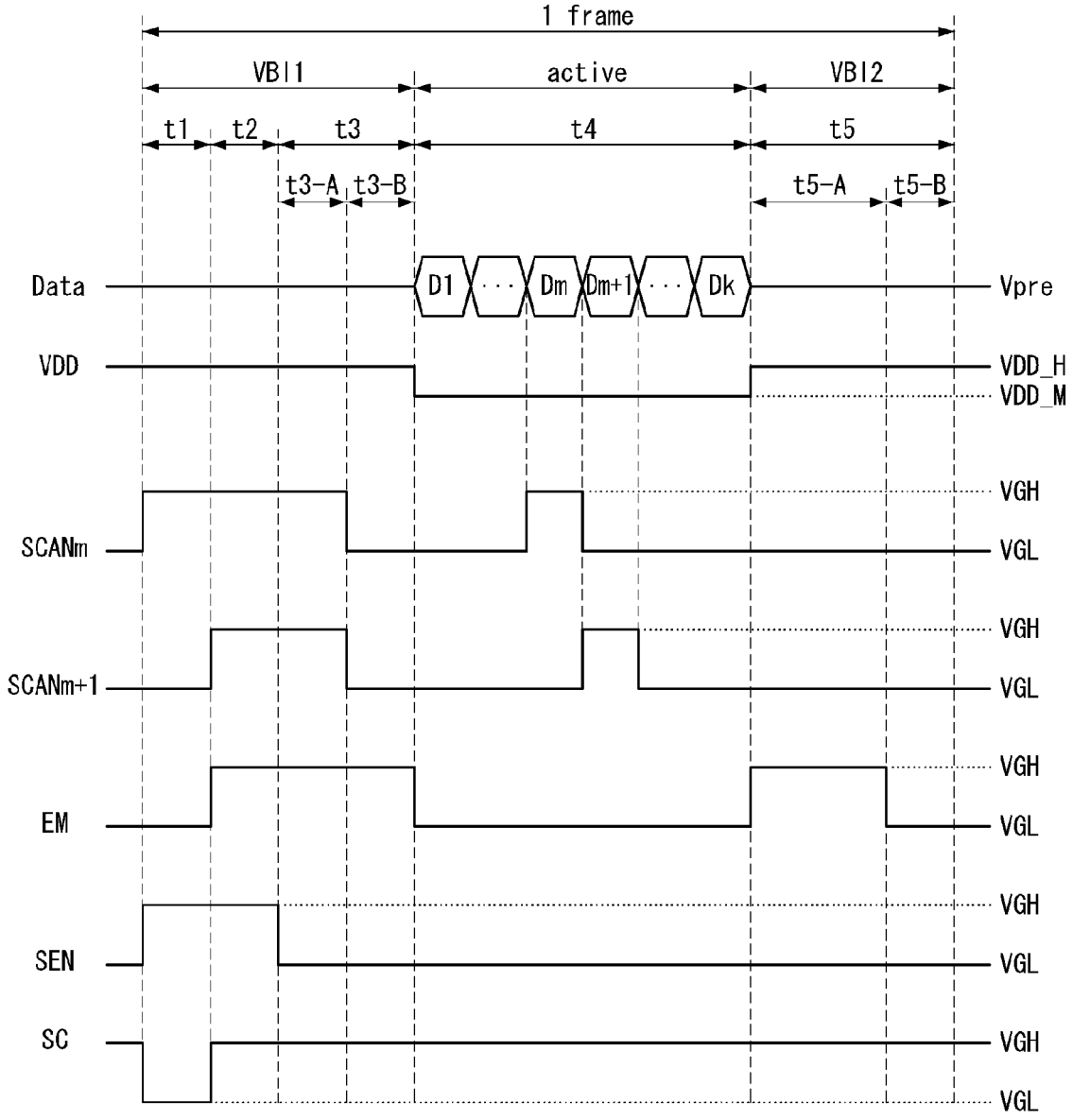
FIG. 8 is a waveform diagram showing signals which are input into a pixel to make internal compensation according to a second embodiment of the present invention.

FIG. 8 is a waveform diagram showing signals which are input into a pixel to make internal compensation according to a second embodiment of the present invention. FIG. 8 depicts a data voltage DATA, a high-potential voltage VDD, scan signals SCANm and SCaNm+1, an emission signal EM, a sensing signal SEN, and a switching control signal SC which are input into the display panel 10 during one frame period to make internal compensation.

The signals input into the pixel P according to the second embodiment of the present invention are similar to the signals input into the pixel P according to the first embodiment of the present invention described in conjunction with FIG. 3, except for the high-potential voltage VDD and the sensing signal SEN. Accordingly, descriptions of the data voltage DATA, scan signals SCANm and SCaNm+1, emission signal EM, and switching control signal SC, among the signals input into the pixel P according to the second embodiment of the present invention, will be omitted.

The high-potential voltage VDD is generated at the high-potential voltage VDD_H of high level during the first to third periods t1 to t3 and the fifth period t5 and at the high-potential voltage VDD_M of middle level during the fourth period t4. The reason why the high-potential voltage VDD is generated at the middle level VDD_M during the fourth period t4 is to prevent an organic light emitting diode OLED from emitting light by the turning-on of a driving TFT DT. As a result, light emission of the organic light emitting diode OLED can be reduced by generating the high-potential voltage VDD at the middle level VDD_M during the fourth period t4, thereby achieving a higher contrast ratio. Also, the sensing signal SEN is generated at the gate high voltage VGH during the first and second periods t1 and t2 and at the gate low voltage VGL during the third to fifth periods t3, t4, and t5.

Hereinafter, an operation of the pixel P during the first to fifth periods t1 to t5 will be described in detail with reference to FIGS. 2 to 8. The operation of the pixel P during the first period t1 and the third to fifth periods t3 to t5 is substantially the same as described above in conjunction with FIGS. 2 to 4. Accordingly, a description of the operation of the pixel P during the first period t1 and the third to fifth periods t3 to t5 will be omitted.

During the second period t2, the mth scan signal SCANm having the gate high voltage VGH is supplied through the mth scan line SLm, and the emission signal EM having the gate low voltage VGL is supplied through the emission line EML. During the second period t2, the sensing signal SEN having the gate high voltage VGH is supplied through the sensing line SENL, and the switching control signal SC having the gate low voltage VGL is supplied through the switching control line SCL. Also, during the second period t2, the data voltage DATA of the preset voltage Vpre is supplied through the nth data line DLn, and the high-potential voltage VDD_H of high level is supplied from the high-potential voltage source.

The first switch S1 is turned on in response to the switching control signal SC having the gate high voltage VGH to couple the reference voltage source to the (n+1)th reference voltage line RLn+1. The second switch S2 is turned off in response to an inverted signal of the switching control signal SC. By the turning-on of the first switch S1 and the turning-off of the second switch S2, the (n+1)th reference voltage line RLn+1 is decoupled from the current sensing circuit ADC and coupled to the reference voltage source.

The first TFT T1 is turned on in response to the mth scan signal SCANm having the gate high voltage VGH to couple the first node N1 to the nth data line DLn. The second TFT T2 is turned on in response to the emission signal EM having the gate high voltage VGH to couple the second node N2 to the third node N3. The third TFT T3 is turned on response to the sensing signal SEN having the gate high voltage VGH to couple the (n+1)th reference voltage line RLn+1 to the second node N2.

As the second node N2 is coupled to the (n+1)th reference voltage line RLn+1, which is coupled to the reference voltage source during the second period t2, the second node N2 is discharged to the reference voltage REF. Also, the second node N2 is coupled to the third node N3 by the turning-on of the second TFT T2, the third node N3 is discharged to the reference voltage REF. It should be noted that the 'reference voltage REF' described in FIG. 8 may be similar to the 'high-potential voltage VDD_L of low level' described in FIGS. 2 to 4.

Figure 9:
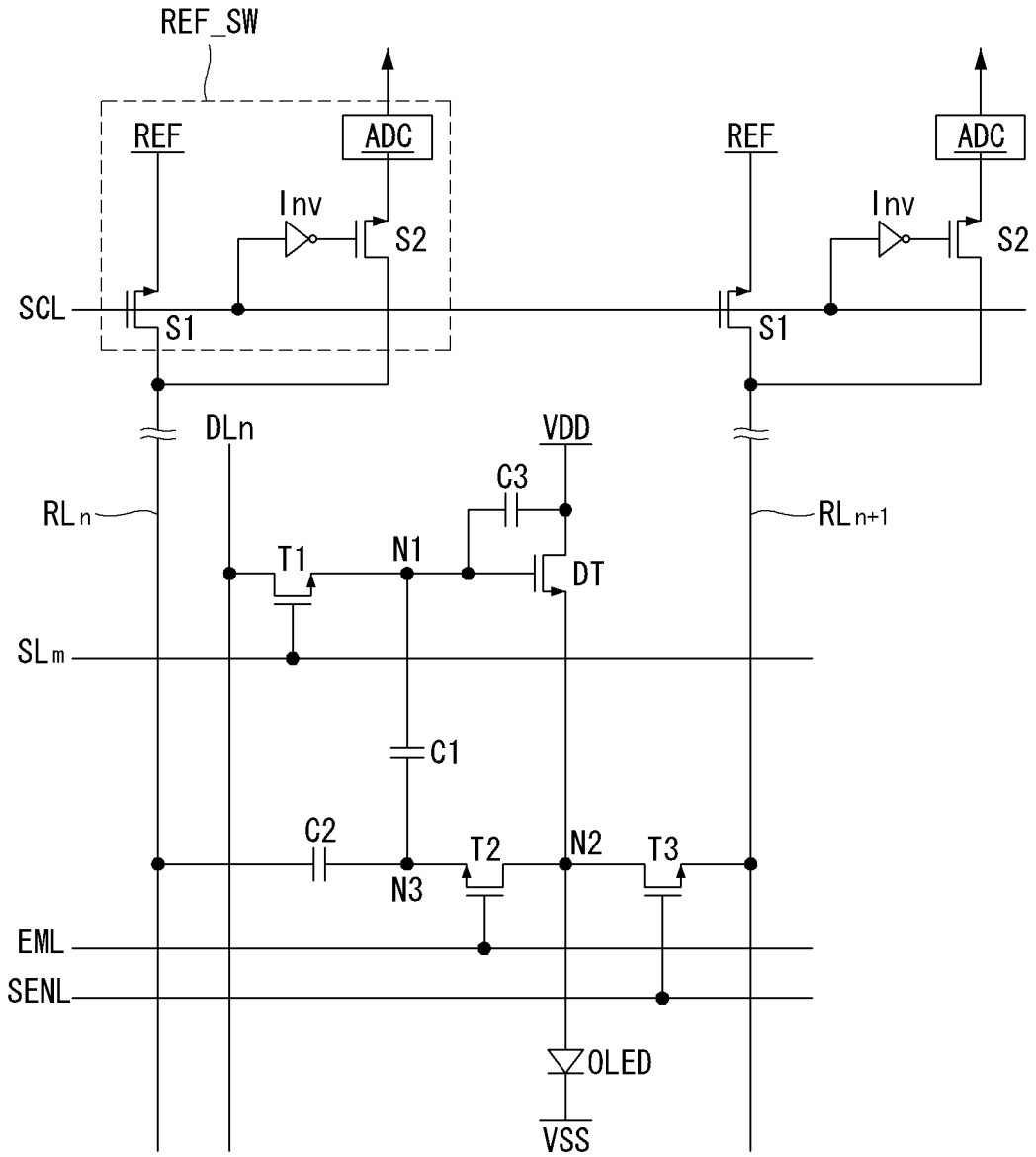
FIG. 9 is an equivalent circuit diagram of a pixel according to the second embodiment of the present invention.

FIG. 9 is an equivalent circuit diagram of a pixel according to a second embodiment of the present invention. The pixel P according to the second embodiment comprises a driving TFT DT, an organic light emitting diode OLED, a control circuit, capacitors, and a reference voltage switching circuit REF SW. The control circuit comprises first to third TFTs T1, T2, and T3, and the capacitors comprise first to third capacitors C1, C2, and C3. The reference voltage switching circuit REF_SW comprises first and second switches S1 and S2, an inverter Inv, and a current sensing circuit ADC.

The structure and operating method of the pixel P according to the second embodiment of the present invention are substantially identical to those of the pixel P according to the first embodiment of the present invention described with reference to FIG. 2, except for the third capacitor C3, so descriptions of the driving TFT DT, organic light emitting diode OLED, first to third TFTS T1, T2, and T3, first and second capacitors C1 and C2, and reference voltage switching circuit REF_SW of the pixel P according to the second embodiment of the present invention will be omitted. Also, signals are input into the pixel P according to the second embodiment of the present invention as shown in FIGS. 3 and 8, and an operation method of the pixel P is similar to that described in conjunction with FIGS. 3 and 8. Accordingly, a description of the pixel P during the first to fifth periods according to the second embodiment of the present invention will be omitted.

The third capacitor C3 is coupled between the first node 1 and the high-potential voltage source, and stores a differential voltage between the first node N1 and the high-potential voltage source. The third capacitor C3 prevents a change in the voltage of the second node N2 from being applied to the first node N1 by a parasitic capacitance of the driving TFT DT. This prevents an increase in the voltage of the first node N1, thereby enhancing grayscale representation capability. That is to say, a higher contrast ratio can be achieved.

Figure 10:
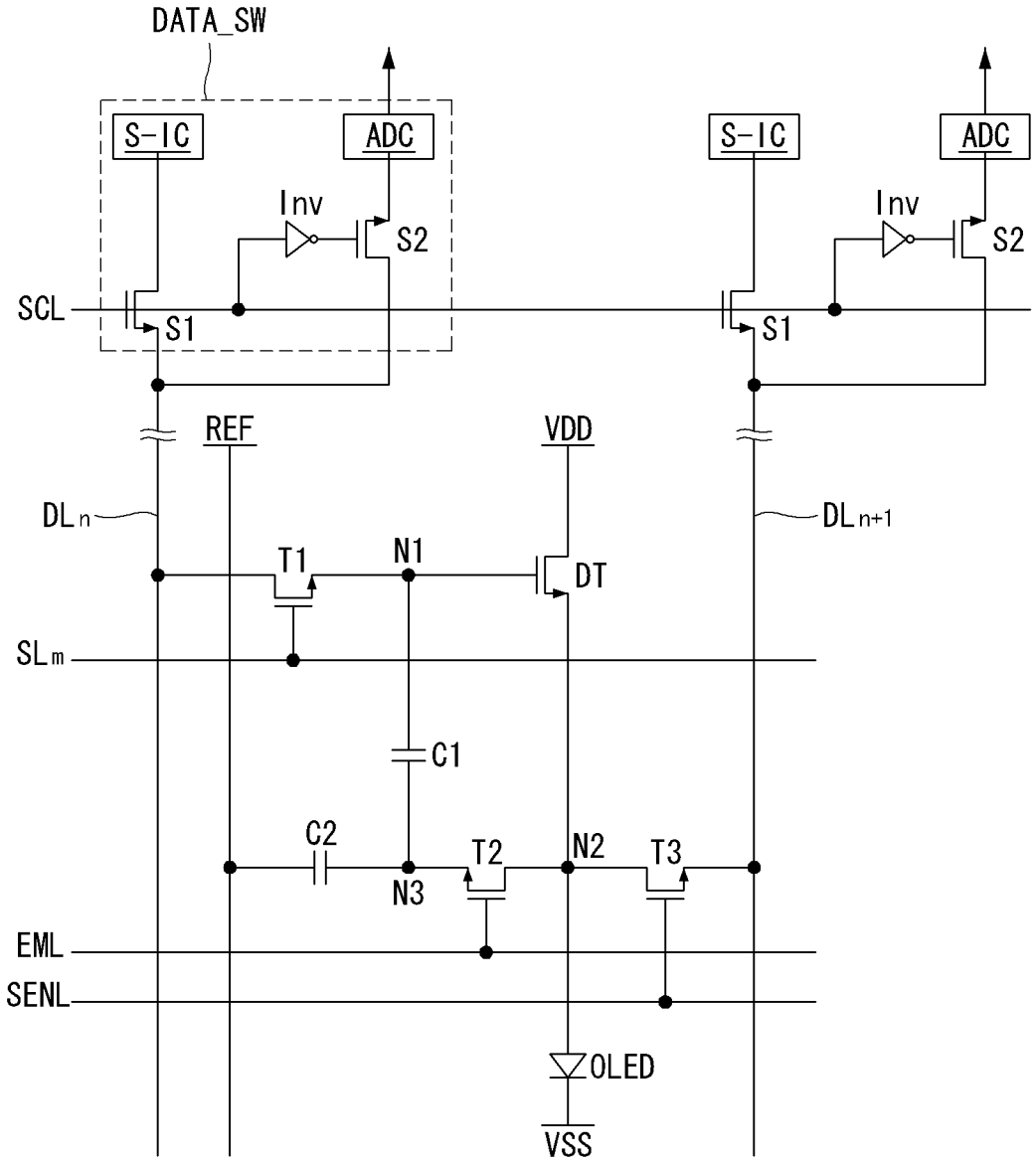
FIG. 10 is an equivalent circuit diagram of a pixel according to a third embodiment of the present invention.

FIG. 10 is an equivalent circuit diagram of a pixel according to a third embodiment of the present invention. Referring to FIG. 10, the pixel P according to the second embodiment comprises a driving TFT DT, an organic light emitting diode OLED, a control circuit, capacitors, and a data voltage switching circuit DATA_SW. The control circuit comprises first to third TFTs T1, T2, and T3, and the capacitors comprise first and third capacitors C1, C2, and C3. The data voltage switching circuit DATA_SW comprises first and second switches S1 and S2, an inverter Inv, and a current sensing circuit ADC.

The structure and operating method of the pixel P according to the third embodiment of the present invention are substantially identical to those of the pixel P according to the first embodiment of the present invention described with reference to FIG. 2, except for the data voltage switching circuit DATA_SW, so descriptions of the driving TFT DT, organic light emitting diode OLED, first to third TFTS T1, T2, and T3, and first and second capacitors C1 and C2 of the pixel P according to the second embodiment of the present invention will be omitted. Also, signals are input into the pixel P according to the third embodiment of the present invention as shown in FIG. 3, and an operation method of the pixel P is similar to that described in conjunction with FIG. 3. Accordingly, a description of the pixel P during the first to fifth periods t1 to t5 according to the third embodiment of the present invention will be omitted.

Each data voltage switching circuit DATA_SW comprises first and second switches S1 and S2, an inverter Inv, a current sensing circuit ADC, and a source drive IC S-IC. It should be noted that, although the first and second switches S1 and S2 have been described as being implemented as N-type MOSFETs, the present invention is not limited thereto. For example, the first and second switches S1 and S2 may be implemented as P-type MOSFETs. The data voltage switching circuit DATA_SW causes the data lines DLn to be coupled to the source drive IC S-IC during second to fifth periods for internal compensation, and causes the data lines DLn to be coupled to the current sensing circuit ADC during a first period for sensing current for external compensation.

The first switch S1 is turned on in response to a switching control signal SC having a gate high voltage VGH supplied from a switching control line SCL to couple the data lines DLn to the source drive IC S-IC supplying a data voltage DATA. A gate electrode of the first switch S1 is coupled to the switching control line SCL, a source electrode thereof is coupled to the data lines DLn, and a drain electrode thereof is coupled to the source drive IC S-IC.

The second switch S2 is turned on in response to the gate low voltage VGL of the switching control signal SC supplied from the switching control line SCL when inverted by inverter Inv to couple the data lines DLn to the current sensing circuit ADC. A gate electrode of the second switch S2 is coupled to the inverter, a source electrode thereof is coupled to the current sensing circuit ADC, and a drain electrode thereof is coupled to the data lines DLn.

The inverter Inv inverts the switching control signal SC supplied from the switching control line SCL. The inverter Inv is coupled between the switching control line SCL and the gate electrode of the second switch S2.

The current sensing circuit ADC is coupled to the data voltage lines DLn and DLn+1 during the first period to sense the current flowing through the data lines DLn and DLn+1. The current sensing circuit ADC converts sensed current into digital data, and outputs the converted digital data to a timing controller 40. The reference voltage source is coupled to the other electrode of the second capacitor C2.

Figure 11:
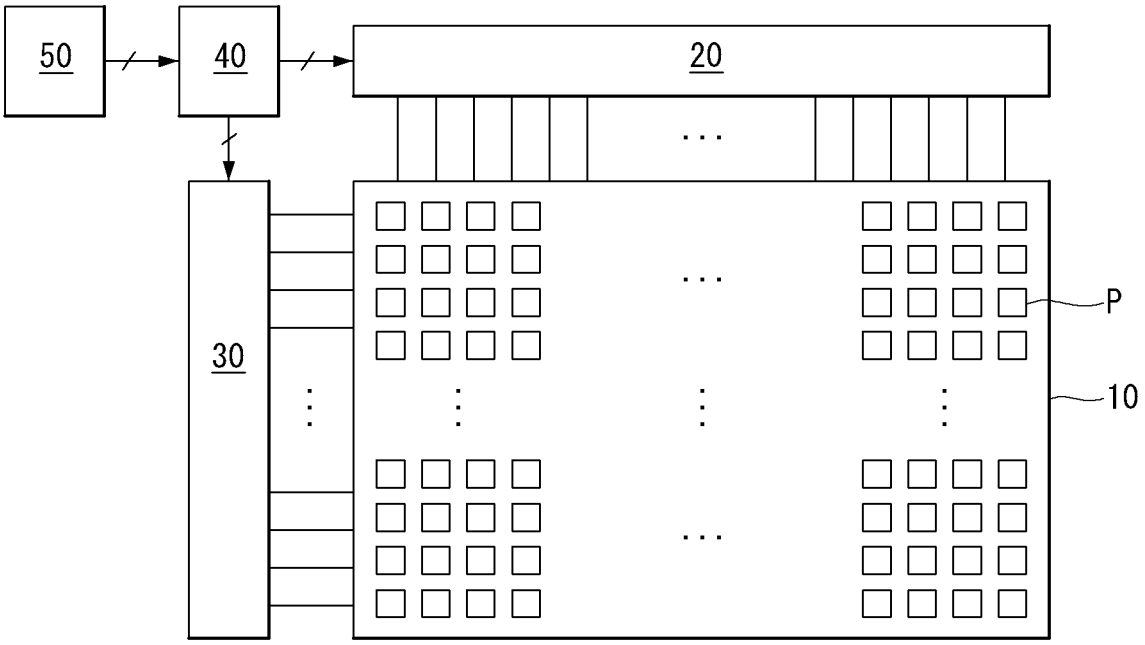
FIG. 11 is a block diagram schematically showing an organic light emitting diode display device according to an embodiment of the present invention.

FIG. 11 is a block diagram schematically showing an organic light emitting diode display device according to an embodiment of the present invention. Referring to FIG. 11, the organic light emitting diode display device according to the embodiment of the present invention comprises a display panel 10, a data driver 20, a scan driver 30, a timing controller 40, and a host system 50.

Data lines DL and scan lines SL crossing each other are formed on the display panel 10. Emission lines EML and sensing lines SENL are formed in parallel with the scan lines SL on the display panel 10. Switching control lines SCL may be formed in parallel with the scan lines SL on the display panel 10. Also, pixels P are arranged in a matrix form on the display panel 10. Each of the pixels P of the display panel 10 is as described in conjunction with FIG. 2, FIG. 9, and FIG. 10.

The data driver 20 comprises a plurality of source drive ICs. The source drive ICs receive digital video data RGB' from the timing controller 40, the digital video data RGB' comprising a compensated threshold voltage Vth and electron mobility of a driving TFT DT and a compensated threshold voltage of an organic light emitting diode OLED. The source drive ICs convert the compensated digital video data RGB' into a gamma compensation voltage in response to a source timing control signal DCS from the timing controller 40 to generate a data voltage and supply the data voltage to the data lines DL of the display panel 10 in synchronization with a scan signal SCAN.

The scan driver 30 comprises a scan signal output part, an emission signal output part, a sensing signal output part, and a switching control signal output part. The scan signal output part sequentially outputs scan signals SCAN to the first scan lines SL1 of the display panel 10. The emission signal output part sequentially outputs an emission signal EM to the emission lines EML of the display panel 10. The sensing signal output part outputs a sensing signal SEN to the sensing lines SENL of the display panel 10. The switching control signal output part sequentially outputs a switching control signal SC to the switching control lines SCL of the display panel 10. Detailed descriptions of the scan signals SCAN, the emission signal EM, the sensing signal SEN, and the switching control signal SC are described in detail in conjunction with FIG. 3 and FIG. 8.

The timing controller 40 receives digital video data RGB from the host system 50 through a low voltage differential signaling (LVDS) interface, a transition minimized differential signaling (TMDS) interface, etc. The timing controller 40 may comprise an external compensator for externally compensating the threshold voltage Vth and electron mobility of the driving TFT and the threshold voltage Vth of the organic light emitting diode OLED. The external compensator 40 applies compensated data, which is calculated using an external compensation method, to the digital video data RGB input from the host system 50, and outputs compensated digital video data RGB' to the data driver 20.

The timing controller 40 receives timing signals such as a vertical synchronization signal, a horizontal synchronization signal, a data enable signal, and a dot clock, and generates timing control signals for controlling operation timings of the data driver 20 and scan driver 30 based on the timing signals from the host system 50. The timing control signals comprise a scan timing control signal for controlling the operation timing of the scan driver 30 and a data timing control signal for controlling the operation timing of the data driver 20. The timing controller 40 outputs the scan timing control signal to the scan driver 30, and outputs the data timing control signal to the data driver 20.

The display panel 10 may further comprise a power supply unit (not shown). The power supply unit supplies a high-potential voltage VDD, a low-potential voltage VSS, and a reference voltage REF to the display panel 10, among other voltage signals and levels described herein. For example, the power supply unit supplies a gate high voltage VGH and a gate low voltage VGL to the scan driver 30.

Figure 12:
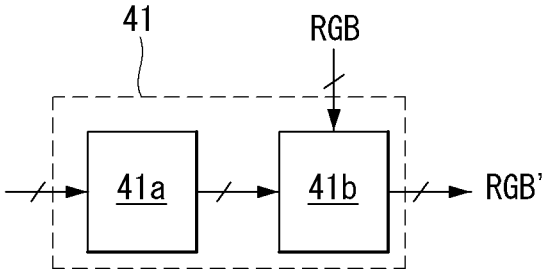
FIG. 12 is a block diagram showing an external compensator of a timing controller.
Figure 13:
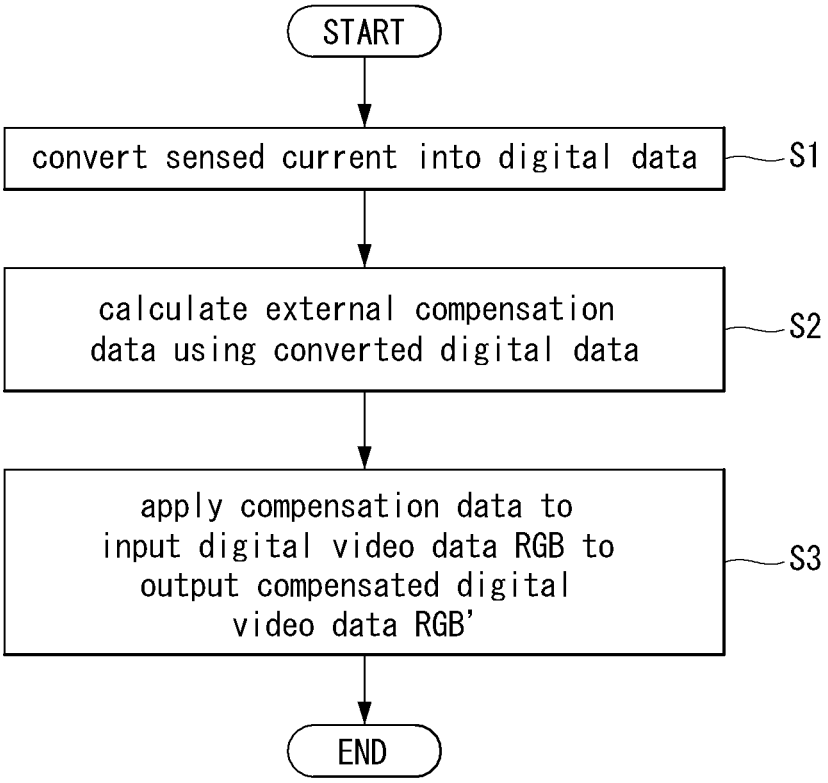
FIG. 13 is a flowchart showing an external compensation method according to an embodiment of the present invention.

FIG. 12 is a block diagram showing an external compensator of a timing controller. FIG. 13 is a flowchart showing an external compensation method according to an embodiment of the present invention. Referring to FIG. 12, the external compensator 41 of the timing controller 40 comprises a compensation data calculator 41*a* and a compensated digital video data output part 41*b*. An external compensation method of the external compensator 41 according to the embodiment will be schematically described below with reference to FIG. 12 and FIG. 13, Firstly, the drain-source current Ids of the driving TFT DT of each of the pixels P and the current Ioled of the organic light emitting diode OLED thereof are sensed by using a current sensing circuit ADC coupled to the second reference voltage line RL2 of each of the pixels P of the display panel 10. The sensing of the drain-source current Ids of the driving TFT DT using the current sensing circuit ADC has been described in detail in conjunction with FIG. 5. The sensing of the current Ioled of the organic light emitting diode OLED using the current sensing circuit ADC has been described in detail in conjunction with FIG. 6 The current sensing circuit ADC converts sensed current into digital data, and outputs the converted digital data to the compensation data calculator 41*a* of the external compensator 41 (S1).

Secondly, the compensation data calculator 41*a* calculates external compensation data by using the digital data input from the current sensing circuit ADC. The compensation data calculator 41*a* can calculate external compensation data, which comprises a compensated threshold voltage Vth and electron mobility of the driving TFT DT and a compensated threshold voltage Vth of the organic light emitting diode, based on the input digital data by using a well-known external compensation calculation method (S2).

Thirdly, the compensated digital video data output part 41*b* receives digital video data RGB from the host system 50, and receives the external compensation data from the compensation data calculator 41*a*. The compensated digital video data output part 41*b* applies the external compensation data to the input digital video data RGB to generate compensated digital video data RGB'. The compensation digital video data output part 41*b* outputs the compensated digital video data RGB' to the data driver 20 (S3).

As discussed above, a gate node of a driving TFT is initialized to a preset voltage during an initialization period, and a source node of the driving TFT is initialized to a high-potential voltage of low level. The high-potential voltage of low level is set to a voltage lower than a differential voltage between the preset voltage and the threshold voltage of the driving TFT. As a result, the voltage difference between the gate and source of the driving TFT is allowed to be larger than the threshold voltage during a threshold voltage sensing period, even if the threshold voltage of the driving TFT is shifted to a negative voltage. Therefore, the threshold voltage can be sensed by using the source node of the driving TFT.

Moreover, the drain-source current of the driving TFT and the current of the organic light emitting diode may be sensed by using reference voltage lines. As a result, the sensed current may be compensated for by an external compensation method. Therefore, the electron mobility of the driving TFT and the threshold voltage of the organic light emitting diode, as well as the threshold voltage of the driving TFT, can be compensated.

Furthermore, a period for sensing the threshold voltage of the driving TFT comprises a period for allowing the gate node of the driving TFT to float. As a result, sensing speed of the threshold voltage of the driving TFT is enhanced by using the period for allowing the gate node of the driving TFT to float.

In addition, a capacitor is coupled between the high-potential voltage source and the gate node of the driving TFT. As a result, an increase in the voltage of the gate node of the driving TFT is prevented during the period in which the gate node of the driving TFT floats, thereby enhancing black grayscale representation capability. Due to this, the present invention offers a higher contrast ratio.

Additionally, the threshold voltage of the driving TFT is sensed during two or more horizontal periods. As a result, the threshold voltage of the driving TFT may be accurately sensed even when a large area, high-resolution organic light emitting diode display device is driven at high speed, such as at a frame frequency of 240 Hz or more.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting diode display comprising a display panel having a data line, a scan line, and an emission line formed thereon and a plurality of pixels arranged in a matrix form, each of the pixels comprising:

a driving TFT comprising a gate electrode coupled to a first node, a source electrode coupled to a second node, and a drain electrode coupled to a high-potential voltage source supplying a high-potential voltage;

an organic light emitting diode comprising an anode coupled to the second node and a cathode coupled to a low-potential voltage source supplying a low-potential voltage;

a first TFT that is turned on in response to a scan signal having a first logic level voltage of a first scan line to couple the first node to the data line;

a second TFT that is turned in response to an emission signal having the first logic level voltage of the emission line to couple the second node to a third node;

a first capacitor coupled between the first node and the third node; and a second capacitor coupled between the third node and a reference voltage source supplying a reference voltage, the reference voltage source being distinct from the high-potential voltage source.

2. The organic light emitting diode display device of claim 1, wherein the high-potential voltage source supplying the high-potential voltage, the scan signal having the first logic level voltage, and the emission signal having the first logic level voltage correspond to a first period of operation and, during a second period for initializing the first to third nodes subsequent to the first period, the scan signal and the emission signal are generated at the first logic level voltage, the high-potential voltage supplies a high-potential voltage of low level and a high-potential voltage of high level, and a preset voltage is supplied to the data line.

3. The organic light emitting diode display device of claim 2, wherein a third period subsequent to the second period and for sensing a threshold voltage of the driving TFT is divided into an A part and a B part, during the A part of the third period, the scan signal and the emission signal are generated at the first logic level voltage, the high-potential voltage source supplies the high-potential voltage of high level, and the preset voltage is supplied to the data line, and during the B part of the third period, the scan signal is generated at a second logic level voltage, which is lower than the first logic level voltage, the emission signal is generated at the first logic level voltage, the high-potential voltage source supplies the high-potential voltage of high level, and the preset voltage is supplied to the data line.

4. The organic light emitting diode display device of claim 3, wherein, during a fourth period subsequent to the third period and for supplying an effective data voltage to the data line, an mth scan signal to be supplied to an mth scan line is generated at the first logic level voltage during a period for synchronization with an mth data voltage and at the second logic level voltage during a remaining period, the emission signal is generated at the second logic level voltage, and the high-potential voltage source supplies a high-potential voltage of middle level.

5. The organic light emitting diode display device of claim 4, wherein a fifth period subsequent to the fourth period and for allowing the organic light emitting diode to emit light is divided into an A part and a B part, during the A part of the fifth period, the scan signal is generated at the second logic level voltage, the emission signal is generated at the first logic level voltage, the high-potential voltage source supplies the high-potential voltage of high level, and the preset voltage is supplied to the data line, and during the B part of the fifth period, the scan signal and the emission signal are generated at the second logic level voltage, the high-potential voltage source supplies the high-potential voltage of high level, and the preset voltage is supplied to the data line.

6. The organic light emitting diode display device of claim 5, wherein a sensing line is further formed on the display panel, each of the pixels further comprises a third TFT that is turned on in response to a sensing signal having the first logic level voltage to connect the second node to an (n+1)th (n is a natural number) reference voltage line, and the second capacitor is coupled between the third node and an nth reference voltage line.

7. The organic light emitting diode display device of claim 6, wherein if the high-potential voltage source supplies the high-potential voltage of low level during the second period, the sensing signal is generated at the first logic level voltage during the first period, which is earlier than the second period, and generated at the second logic level voltage during the second to fifth periods.

8. The organic light emitting diode display device of claim 6, wherein if the high-potential voltage source supplies the high-potential voltage of high level during the second period, the sensing signal is generated at the first logic level voltage during the first period, which is earlier than the second period, and the sensing signal is generated at the second logic level voltage during the third to fifth periods.

9. The organic light emitting diode display device of claim 7, wherein, during the first period, the scan signal is generated at the first logic level voltage, the emission signal is generated at the second logic level voltage, the high-potential voltage source supplies the high-potential voltage of high level, and the preset voltage is supplied to the data line.

10. The organic light emitting diode display device of claim 9, wherein a differential voltage between the preset voltage and the high-potential voltage of low level is greater than the threshold voltage of the driving TFT, or a differential voltage between the preset voltage and the reference voltage is greater than the threshold voltage of the driving TFT.

11. The organic light emitting diode display device of claim 9, wherein, in a case of sensing a drain-source current of the driving TFT, a differential voltage between the preset voltage and the high-potential voltage of low level is greater than the threshold voltage of the driving TFT, and in a case of sensing a current of the organic light emitting diode, a differential voltage between the preset voltage and the reference voltage is greater than the threshold voltage of the driving TFT.

12. The organic light emitting diode display device of claim 9, wherein the fourth period is an active period for supplying an effective data voltage to the display panel, the first to third periods are a first vertical blank interval before an active interval, and the fifth period is a second vertical blank interval after the active interval.

13. The organic light emitting diode display device of claim 6, wherein a switching control line is further formed on the display panel, the display panel further comprising:

a first switch that is turned on in response to a switching control signal having the first logic level voltage of the switching control line to couple the reference voltage source to the (n+l)th reference voltage line;

an inverter that inverts the switching control signal; and a second switch that is turned on in response to the first logic level voltage of the switching control signal inverted by the inverter to couple a current sensing circuit to the (n+1)th reference voltage line, wherein the switching control signal is generated at the second logic level voltage during the first period, and at the first logic level voltage during the second to fifth periods.

14. The organic light emitting diode display device of claim 5, wherein a sensing line is further formed on the display panel, each of the pixels further comprises a third TFT that is turned on in response to a sensing signal having the first logic level voltage to couple the second node to an (n+1)th (n is a natural number) data line, and the first TFT is coupled to an nth data line.

15. The organic light emitting diode display device of claim 14, wherein if the high-potential voltage source supplies the high-potential voltage of low level during the second period for initializing the first to third nodes, the sensing signal is generated at the first logic level voltage during the first period, and generated at the second logic level voltage during the second to fifth periods, wherein during the first period, the scan signal is generated at the first logic level voltage, the emission signal is generated at the second logic level voltage, the high-potential voltage source supplies the high-potential voltage of high level, and the preset voltage is supplied to the data line.

16. The organic light emitting diode display device of claim 15, wherein a differential voltage between the preset voltage and the high-potential voltage of low level is greater than the threshold voltage of the driving TFT.

17. The organic light emitting diode display device of claim 15, wherein, in a case of sensing a drain-source current of the driving TFT, a differential voltage between the preset voltage and the high-potential voltage of low level is greater than the threshold voltage of the driving TFT, and in a case of sensing a current of the organic light emitting diode, a differential voltage between the preset voltage and the reference voltage is greater than the threshold voltage of the driving TFT.

18. The organic light emitting diode display device of claim 15, wherein the fourth period is an active period for supplying an effective data voltage to the display panel, the first to third periods form a first vertical blank interval before an active interval, and the third subsequent period is a second vertical blank interval after the active interval.

19. The organic light emitting diode display device of claim 14, wherein a switching control line is further formed on the display panel, the display panel further comprising:

a first switch that is turned on in response to a switching control signal having the first logic level voltage of the switching control line to couple a source drive IC supplying a data voltage to the (n+1)th data line;

an inverter that inverts the switching control signal; and a second switch that is turned on in response to the first logic level voltage of the switching control signal inverted by the inverter to couple a current sensing circuit to the (n+1)th data line, wherein the switching control signal is generated at the second logic level voltage during the first period, and at the first logic level voltage during the second to fifth periods.

20. The organic light emitting diode display device of claim 1, wherein each of the pixels further comprises a third capacitor coupled between the first node and the high-potential voltage source.

* * * * *